United States Patent [19]

Klefisch

[11] 3,950,246

[45] Apr. 13, 1976

[54] DREDGE UNITS

[76] Inventor: Dieter G. A. Klefisch, 1021 Bridgeport Road, Richmond, British Columbia, Canada, V6X 1S9

[22] Filed: Dec. 10, 1974

[21] Appl. No.: 531,389

[30] Foreign Application Priority Data

Oct. 25, 1974 Canada ..... 212320

[52] U.S. Cl. ..... 209/44; 209/458; 209/485; 209/488; 209/500; 299/9

[51] Int. Cl.[2] ..... B03B 5/26

[58] Field of Search ..... 299/7-9; 209/44, 437, 443, 458, 488, 497, 485, 500, 506, 460

[56] References Cited

UNITED STATES PATENTS

| | | | |
|---|---|---|---|
| 594,041 | 11/1897 | Strong | 209/458 X |
| 855,200 | 5/1907 | Pennick et al. | 299/9 |
| 1,208,880 | 12/1916 | Wright et al. | 209/458 X |
| 1,490,016 | 4/1924 | Mackenzie | 209/458 X |
| 1,973,770 | 9/1934 | McCullough | 209/44 X |
| 1,987,475 | 1/1935 | Hanson | 209/44 X |
| 2,073,122 | 3/1937 | Silke | 209/458 X |
| 3,045,623 | 7/1962 | Tyler | 37/DIG. 8 |
| 3,161,438 | 12/1964 | Novak | 209/458 X |
| 3,558,043 | 1/1971 | Smith et al. | 209/44 X |

*Primary Examiner*—Frank W. Lutter
*Assistant Examiner*—Ralph J. Hill
*Attorney, Agent, or Firm*—Larson, Taylor and Hinds

[57] ABSTRACT

A dredge unit having a buoyant support carrying a sluice box suspended beneath, a water suction system connected to an outlet end on the box and a suction hose operatively connected to an inlet end thereof. The water suction system operates to draw water and material through the suction hose and into the sluice box where material of relatively high specific gravity is contained while the remainder and the water is discharged from the system.

16 Claims, 6 Drawing Figures

20
12
62
22
10
2
2
75
55
54
36
33
16
64
14
37
67
68

22
20
10
25
5
5
55
29
28
14
54
28
16
70
67
68
62
24
25

4
23
62
10
22
38
38
25
37
36
WATER LEVEL
55
24
70
68
29
60
54
14
64
16
28
33
67
4

DREDGE UNITS

This invention relates to dredge units which can float on a body of water and be operated to suck up materials, such as sand and gravel, from the bottom of the body of the water.

Although this dredge unit was designed particularly for the extraction of gold from alluvial material, other valuable metals, minerals and gem stones can be recovered. Although the apparatus is primarily for extracting materials of relatively high specific gravity from other materials with which they are mixed, it will be obvious that the dredge unit can be used for other purposes such as, for example, plain dredging.

For the sake of convenience, the dredge unit will be described in connection with the recovery of gold which is its prime purpose. As is well known, sluice boxes have been used for the recovery of gold for a great many years. The old hand-operated sluice boxes were cumbersome, back-breaking to operate, and very inefficient. In recent years, suction dredges have been used to suck up materials from the bottoms of rivers and lakes for large sluice boxes. Such equipment is large, very expensive, and cannot economically be transported to remote regions where the gold may be found. In addition, the suction dredge equipment is out of reach of many individuals for economical reasons.

The present dredge unit is of such simple construction that can be sold at a price where it is readily available to the amateur and professional wanting to search for gold on his own. The equipment is very small and light in weight so that a man can easily pack it into remote places where gold is most likely to be found. It can handle large volumes of material in a short time, and is so efficient that it is often possible to work the tailings of previous, less efficient recovery systems. A very important feature of this apparatus is that the material is never lifted out of the water during operation of the unit. The gravel is vacuumed, classified and exhausted without breaking the surface of the water and thus losing the buoyancy effect, and this results in an exceptionally high efficiency to weight ratio. In addition, the pump of the present apparatus does not require priming before it will start to function properly.

Generally speaking, this dredge unit includes a motor-driven pump which forces water under high pressure into an exhaust portion of the dredge system. This creates a high vacuum throughout the system, and during the time an intake hose is introduced into the gravel, the material sucked up passes through a sluice box and is finally expelled from the exhaust end of the system. As the gravel passes over the sluice box, the larger rocks are prevented from entering the riffle system of the box, thereby passing over the top and are expelled, and the heavy material enters a sluice system and is gravity classified by a combination of riffles in the box and by vibration created by the motor. Below the riffles is a mat to aid in the holding of the fine gold concentrate.

A dredge unit in accordance with this invention comprises a support platform, a sluice box suspended in a substantially horizontal position from the platform, said box having an inlet end and an outlet end, a riffle and mat arrangement along the bottom of the sluice box, a water suction system connected to the other end of the box to draw water through said box and discharge the water therefrom, and a suction hose operatively connected to the inlet end of the box, whereby operation of the suction system draws water and material through the suction hose and over the riffle and mat arrangement where material of relatively high specific gravity is retained in said mat system, and discharges the remainder of the material and the water.

More specifically, the present dredge unit comprises an annular and buoyant support adapted to float on a body of water, a frame within and connected to the annular support, a sluice box suspended in a substantially horizontal position from said frame and below the support, said box having an inlet end and an outlet end, a riffle and mat arrangement along the bottom of the sluice box, a water suction system connected to the outlet end of the box to draw water through said box and discharge the water therefrom, and a suction hose operatively connected to the inlet end of the box, whereby operation of the suction system draws water and material through the suction hose and over the riffle and mat arrangement where material of relatively high specific gravity is retained in said mat system, and discharges the remainder of the material and the water.

A preferred form of dredge unit is illustrated in the accompanying drawings in which.

Figure 2:
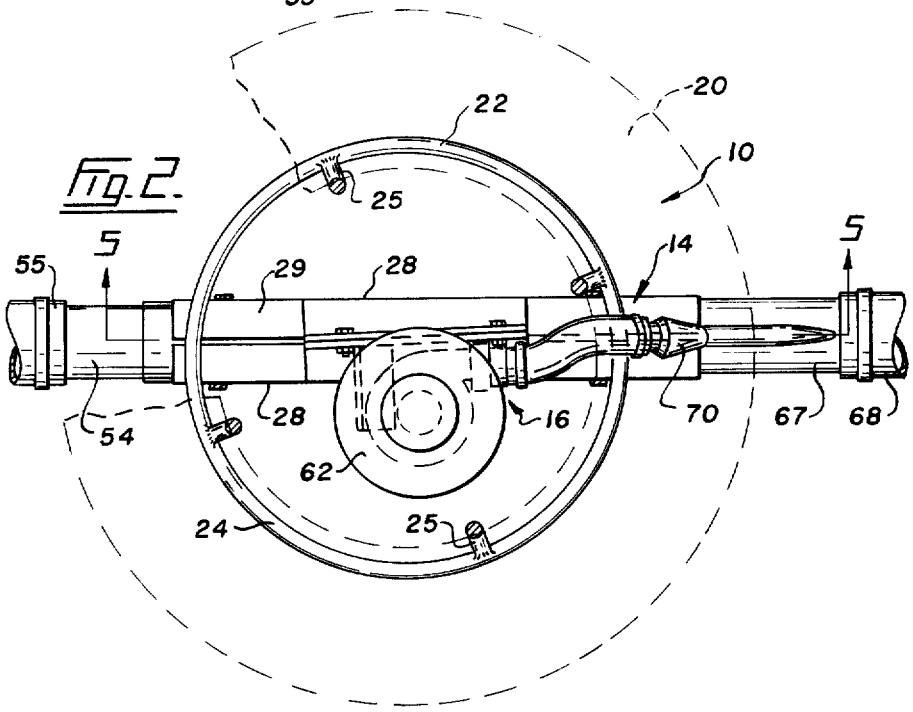
FIG. 2 is an enlarged horizontal section taken on the line 2—2 of FIG. 1, with the buoyant support of the unit omitted.
Figure 3:
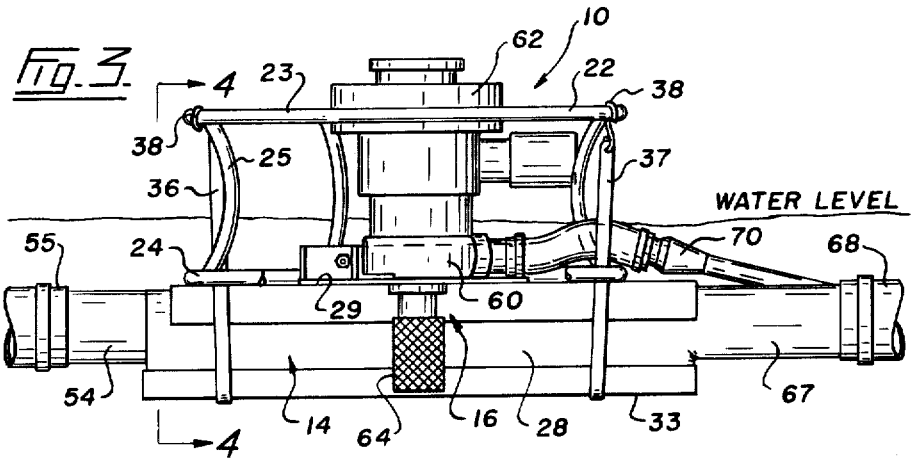
Figure 4:
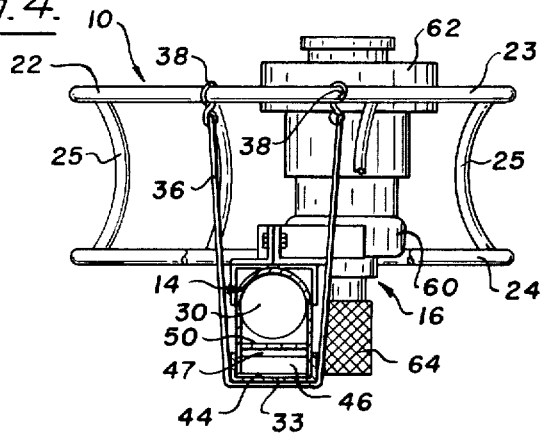
Figure 5:
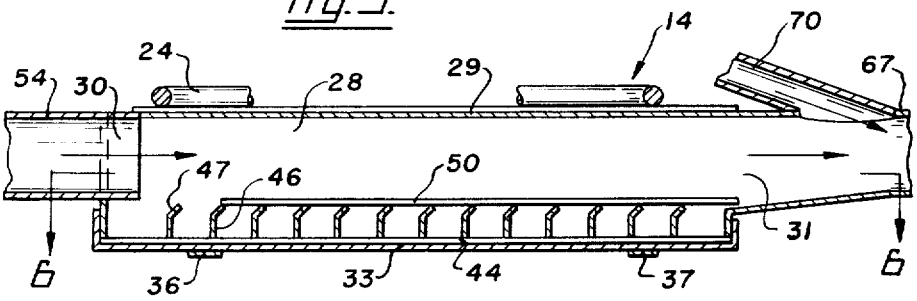
Figure 6:
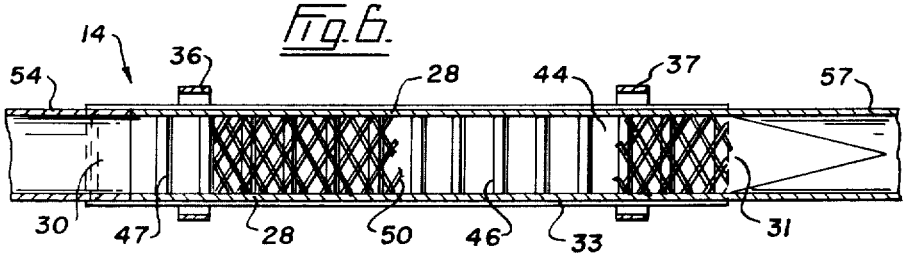

FIG. 3 is an enlarged side elevation of the unit, but with the buoyant support omitted, FIG. 4 is a vertical section taken on the line 4—4 of FIG. 3, FIG. 5 is an enlarged longitudinal section on the line 5—5 of FIG. 2, showing the sluice box, and FIG. 6 is a horizontal section taken on the line 6—6 of FIG. 5.

Referring to the drawings, 10 is a dredge unit in accordance with this invention which comprises generally a support platform 12, a sluice box 14, and a water suction system 16.

In the preferred form of the invention, the support platform 12 comprises an annular buoyant support 20 which is preferably in the form of an inflatable rubber tube which can be deflated for storage and transportation, and readily inflated when it is required. A support frame 22 is positioned within and connected to tube 20. The frame is preferably made up of aluminum tubing, and includes upper and lower rings 23 and 24 which are interconnected by spacers 25. These spacers curve inwardly relative to the upper and lower rings so that they act along with these rings as a rim for tube 20. When the tube is placed around the spacers and is inflated, it partially fits between rings 23 and 24 so that it is firmly retained in place without the necessity of any additional fastening means.

The sluice box 14 has sides 28, a top 29, an open inlet end 30, and an open outlet end 31. The box also has a bottom 33 which is preferably removably mounted thereon. The sluice box is suspended from and secured to the bottom of frame 22 in any convenient manner. The preferred way is to use straps 36 and 37 which extend around the bottom of the box and upwardly inside lower ring 24 to upper ring 23 on which they are releasibly connected by hooks 38, see FIGS. 3 and 4. These straps can be formed of slightly resilent material so that they are maintained under tension firmly to hold the box against the underside of the frame 22.

Sluice box 14 also includes a mat 44 mounted on the upper surface of bottom 33, and a plurality of transverse riffles 46 which are longitudinally spaced from each other throughout the length of the box, see FIGS. 5 and 6, and are connected at their ends to the side walls 28 of the box. These riffles are located immediately above mat 44. The upper sections 47 of the riffles are inclined in the downstream direction, that is, towards the outlet end 31 of the box. A grizzly or grid 50 rests on the upper edges of riffles 47 and extends either the full length of the sluice box or partly throughout said length, as shown.

Sluice box 14 may be provided with an entrance tube 54 which is connected to the box and extends slightly into the latter at the inlet end 30 thereof and above the riffles, see FIG. 5. A suction hose 55 is connected to tube 54, said hose being any desired length. Actually, hose 55 and tube 54 form a suction hose leading into the upstream end 30 of the sluice box.

The water suction system 16 of unit 10 includes a water pump 60 mounted on the top of sluice box 14 so that it is actually carried by frame 22. A suitable power unit is provided for pump 60, such as an internal combustion engine 62 mounted on top of the pump and operatively connected thereto. This pump has an inlet tube 64 which projects downwardly beside box 14.

A tube 67 is connected to the downstream end of box 14 and opens through the outlet end 31 thereof. This tube is connected to a flexible exhaust hose 68, of any desired length. Pump 60 directs a jet of water from its outlet through a pipe arrangement 70 into tube 67 of the exhaust hose and in the direction away from the sluice box. The jet of water directed into the suction hose creates suction in the sluice box and suction hose 55 so that sand and gravel can be sucked up said hose, through the sluice box and discharged through exhaust hose 68.

It will readily be seen that the dredge unit 10 is quite light in construction. It is made up of the inflated tube 20, tubular frame 22, sluice box 14, pump 60 and motor 62. The motor and pump are the heaviest components of this unit.

Figure 1:
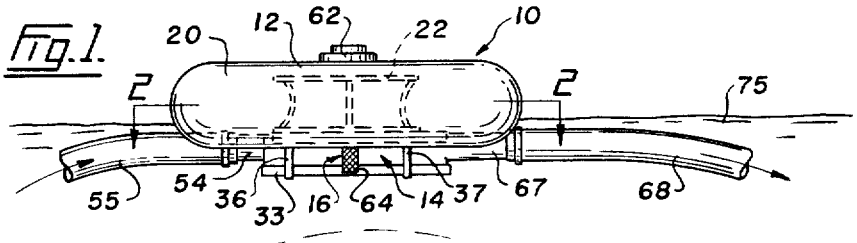
FIG. 1 is a side elevation of the dredge unit located in a body of water.

When it is desired to use dredge unit 10, it is placed in a body of water, indicated at 75 in FIG. 1. Tube 20 supports the sluice box 14 in the water, and hoses 55 and 68 extend away from opposite ends of the box within the water. As the pump is immersed in the water, it does not require any priming. When motor 62 is operating, pump 60 directs a jet of water into exhaust hose 68 so that as the outer end of suction tube 55 is moved over the sand and gravel at the bottom of the body of water, the sand and gravel is sucked up into and through the sluice box where the materials of relatively heavy specific gravity are retained, and the tailings or remainder of the material is discharged through hose 68. Thus, the material is never lifted out of the water so that the buoyancy is never lost.

As the material passes through box 14, the coarse or large particles are kept clear of the riffle system by grizzly 50 and are discharged through hose 68. The finer materials pass over the riffles, and are classified in the usual manner of a sluice box. The riffles classify the remainder of the material, and this is assisted by the vibration of motor 62 which is mounted on pump 60 and which, in turn, is mounted on the sluice box. Mat 44 retains the fine gold concentrate.

Dredge unit 10 can be made in any desired proportions. The following are the statistics for a small unit which is readily transported by one man.

The sluice box is 4 inches wide and about 30 inches long. Motor 62 is a 8 horse power, 2 cycle engine which will operate for about 90 minutes on 1 gallon of oil-gasoline mixture. The pump delivers up to 200 gallons of water per minute. This unit functions satisfactorily with a suction hose of a length of from about 15 to 50 feet, and the total weight of the unit is about 84 pounds.

The fuel container for unit 10 has not been shown or described above. Such a container can be mounted on frame 22, but it is possible to provide a separate unit which is similar to unit 10. Such a unit can have an inflatable tube 20 and a tubular frame 22 formed with a bottom so that the fuel container can rest thereon within the tube.

I claim:

1. A portable dredge unit comprising a frame formed by upper and lower rings interconnected by spacers, an inflatable buoyancy tube fitting between the rings and against the spacers to support the frame on a body of water, a substantially horizontal sluice box, means connected to said frame and the sluice box to suspend said box immediately below the frame, said box having an inlet end and an outlet end, a suction hose operatively connected to the inlet end of the box, a riffle and mat arrangement along the bottom of the sluice box, and a water suction system connected to the outlet end of the box and discharging into said outlet end in the direction away from the box to draw water through said suction hose and the box and to discharge the water therefrom, whereby operation of the suction system draws water and material through the suction hose and over the riffle and mat arrangement where material of relatively high specific gravity is retained in said riffle and mat system, and discharges the remainder of the material and the water.

2. A dredge unit as claimed in claim 1 in which said suction system comprises an exhaust hose connected to the outlet end of the sluice box, a pump having an inlet near the sluice box and an outlet, and a hose connected to said outlet and to said exhaust hose so that water discharged by the pump causes suction in the box to draw the water and material therein through the suction hose.

3. A dredge unit as claimed in claim 1 in which said sluice box is provided with a removable bottom to permit removal of the high specific gravity material therefrom.

4. A dredge unit as claimed in claim 1 in which said riffle and mat arrangement comprises a mat on the bottom of the box, and a plurality of transverse riffles spaced apart longitudinally of the box, said riffles being positioned immediately above the mat.

5. A dredge unit as claimed in claim 1 in which said riffle and mat arrangement comprises a mat on the bottom of the box, and a plurality of transverse riffles spaced apart longitudinally of the box, said riffles being secured to the sides of the box and being positioned immediately above the mat.

6. A dredge unit as claimed in claim 1 including a grizzly extending over the riffle and mat arrangement throughout at least part of the length of the box to prevent coarse material from contacting said riffle and mat arrangement.

7. A dredge unit as claimed in claim 1 in which said suction system comprises a pump having an inlet near the sluice box and an outlet, and a hose connected to said outlet and to the outlet end of the box so that water discharged by the pump causes suction in the box to draw the water and material therein through the suction hose.

8. A dredge unit as claimed in claim 1 in which said suction system comprises a pump having an inlet near the sluice box and an outlet, said pump being mounted so as to be immersed in the water when said unit is in operation, and a hose connected to said outlet and to the outlet end of the box so that water discharged by the pump causes suction in the box to draw the water and material therein through the suction hose.

9. A portable dredge unit comprising an annular and buoyant support adapted to float on a body of water, a frame within and connected to the annular support, a sluice box suspended from the frame in the water in a substantially horizontal position immediately below said frame, said box having an inlet end and an outlet end, a suction hose operatively connected to the inlet end of the box, a riffle and mat arrangement along the bottom of the sluice box, a power-driven pump supported by said frame within the annular support and above the sluice box, said pump having an inlet below the support and an outlet, a pipe connected to said pump outlet and to the outlet end of the box and extending in the direction to discharge into said outlet end away from the box, said pump during operation discharging water into the box outlet end in the direction away from the box to cause suction in the box and the suction hose, whereby said suction draws water and material through the suction hose and over the riffle and mat arrangement where material of relatively high specific gravity is retained in said riffle and mat system, and discharges the remainder of the material and the water.

10. A portable dredge unit as claimed in claim 9 in which said pump is positioned so as to be immersed in the water when said unit is in operation.

11. A portable dredge unit as claimed in claim 9 in which said pump is mounted on the sluice box, and including an internal combustion engine carried by the support and operatively connected to the pump.

12. A dredge unit as claimed in claim 9 in which said riffle and mat arrangement comprises a mat on the bottom of the box and a plurality of transverse riffles spaced apart longitudinally in the box, said riffles being positioned immediately above the mat.

13. A dredge unit as claimed in claim 9 in which said support is deflatable and is releasably connected to said frame.

14. A dredge unit as claimed in claim 9 in which said sluice box is provided with a removable bottom to permit removal of the high specific gravity material therefrom.

15. A dredge unit as claimed in claim 14 in which said riffle and mat arrangement comprises a mat on the bottom of the box, and a plurality of transverse riffles spaced apart longitudinally in the box, said riffles being secured to the sides of the box and being positioned immediately above the mat.

16. A dredge unit as claimed in claim 9 including a grizzly extending over the riffle and mat arrangement throughout at least part of the length of the box to prevent coarse material from contacting said riffle and mat arrangement.

* * * * *